US005249533A

United States Patent [19]

Moore, III

[11] Patent Number: 5,249,533

[45] Date of Patent: Oct. 5, 1993

[54] SEWING MACHINE TABLE

[75] Inventor: Edgar F. Moore, III, Greensboro, N.C.

[73] Assignee: Barudan America, Inc., Walton Hills, Ohio

[21] Appl. No.: 732,167

[22] Filed: Jul. 18, 1991

[51] Int. Cl.[5] ..... A47B 1/04

[52] U.S. Cl. ..... 108/69; 108/138; 108/71; 248/280.1

[58] Field of Search ..... 108/71, 68, 76, 60, 108/70, 72, 65, 64, 73, 74, 143, 138; 248/281.1, 919, 918, 920, 280.1

[56] References Cited

U.S. PATENT DOCUMENTS

| | | | |
|---|---|---|---|
| 464,115 | 12/1891 | Cobham | 108/73 |
| 1,139,730 | 5/1915 | Schlueter | 108/74 |
| 1,994,538 | 3/1935 | Segal | 108/73 |
| 2,170,098 | 8/1939 | Stephenson | 108/138 X |
| 3,464,303 | 9/1969 | Mohr | 108/73 X |
| 4,194,452 | 3/1980 | Crowther et al. | 108/138 |
| 4,616,798 | 10/1986 | Smeenge et al. | 108/69 X |
| 4,644,875 | 2/1987 | Watt | 108/143 X |

FOREIGN PATENT DOCUMENTS

| | | | |
|---|---|---|---|
| 2721583 | 11/1978 | Fed. Rep. of Germany | 108/71 |
| 1248781 | 12/1957 | France | 108/73 |

*Primary Examiner*—Jose V. Chen

[57] ABSTRACT

A sewing machine table is presented having a first top section which is rigidly mounted to the table frame and a second section which abuts the first section in horizontal alignment when raised and which is rotatably affixed to the frame for movement away from said first top section. The sewing machine table can be used to sew flat goods with the first and second top sections in contiguous horizontal alignment. A pivotable mechanism allows the second top section to pivot away and downwardly from the first table top section for sewing more dimensioned goods such as baseball caps and the like.

12 Claims, 3 Drawing Sheets

SEWING MACHINE TABLE

BACKGROUND OF THE INVENTION

1. Field Of The Invention

The present invention relates to sewing machine tables and particularly to industrial type sewing machine tables which are used with multiple sewing machine heads whereby two or more items are sewn or embroidered simultaneously. Specifically, the invention described herein pertains to a table which will enable the operator to change the sewing machines from acceptance of flat goods such as open shirts to acceptance of three dimensional goods such as baseball caps for embroidering or stitching.

2. Description Of The Prior Art And Objectives Of The Invention

It has become increasingly popular in recent years to sew and embroider various garments such as shirts, pants, jackets, caps and the like. Trademarks, company names, and the names of social organizations are now routinely placed on garments and various groups have increasingly sought uniforms or other matching garments to wear at different events and occasions with identical logos. Commercial sewing machines which utilize a plurality of sewing heads are in wide spread use whereby an operator may stitch or sew, by computer control, the logo or name simultaneously on a plurality of similar articles of wearing apparel. "Flat goods" embroidering is conventionally done with sewing machines employing a standard table or bed whereby the goods are positioned thereon in frames and logos or the like are embroidered on multiple pieces at the same time. However, when so called "three dimensional" objects such as baseball caps or the like are to be embroidered, the sewing table or bed has to be removed or positioned out of the way since a frame for insertion into the cap is affixed to the machine proximate the sewing machine needles for maintaining the cap in a proper position during stitching. Such cap frames are generally circular and cannot lay on a conventional flat sewing table. Thus, the sewing table must be removed and positioned out of the way while the operator modifies the sewing machine equipment to receive the cap frames. Commercial sewing machines employing a series of two (2) or more sewing heads utilize a flat, heavy laminated table. Such sewing machine tables are not only heavy but are bulky and must be handled with care to prevent damage thereto. These tables are also difficult to remove by even a pair of operators, and if care is not taken, can accidentally strike the needles of the sewing machines during removal or replacement, causing delays and added expense in the set up or take down time.

Thus, with the problems and disadvantages of the removal of conventional sewing machine tables from conventional sewing machines having multiple sewing heads, the present invention was conceived and one of its objectives is to provide a sewing machine table which will allow the operator to easily convert from sewing flat goods to three dimensional objects such as baseball caps, or tubular goods such as polo shirts, pockets, pant legs or other items and back again.

It is another objective of the present invention to provide a sewing machine table which includes a mechanism for allowing the table to move downwardly, away from the sewing machine needles and cylinder arms which houses thread bobbins.

It is yet another objective of the present invention to provide a mechanism for a sewing machine which includes a pair of pivot arms and coil springs which help maintain the table in either a raised or lowered position.

It is still another objective of the present invention to provide a sewing machine table mechanism which allows for easy table movement and includes a crank member to which an L-shaped arm and a linear arm are attached.

It is still another objective of the present invention to provide a sewing machine table mechanism which includes a hydraulic cylinder for dampening the upward movement of the table to insure a smooth, safe table conversion operation.

Various other objectives and advantages of the present invention become apparent to those skilled in the art as a more detailed presentation is provided below.

SUMMARY OF THE INVENTION

The aforesaid and other objectives are realized by providing a sewing machine table which includes a mechanism whereby the table can be released and urged simultaneously, downwardly and horizontally away from the sewing machine heads and cylinder arms. The mechanism is affixed to the frame of the sewing machine table and included is a first rear table top section which is permanently joined to the frame. A second or complementary front table top section is mechanically attached to the frame by a mechanism hereinafter more completely described which allows the second section to move from a first position in contiguous horizontal alignment with the first table top section to a second position vertically spaced from said first top section, therebelow and out of the way whereby the operator can affix cap frames proximate the sewing machine heads for embroidering thereon goods such as jerseys, polo shirts or the like. The extended sewing machine table may include three separate mechanisms affixed to the frame for smooth efficient mechanical movement of the second table top section, the exact number of mechanisms depending on the length and weight of the particular table top encountered. The mechanisms include a pair of arms which are rotatably affixed to the sewing machine table frame and are likewise affixed to a crank member attached to the second or movable top section. A first coil spring constantly urges the second top section upwardly while a second spring helps maintain the movable top section in either the raised or lowered position as the spring rotates below a pivot point. Each spring is adjustable so as to counter balance different table weights. An alignment member attached to the second table top section for contact with the first or fixed top section and prevents further upward movement of the second top section. A means to dampen the upward motion of the movable table top is included in the form of one or more hydraulic cylinders which are attached to one of the arms. The movable mechanisms described allow the second table top section to move either upwardly or downwardly by manual urging by a single operator and a latch is provided to hold the second table top section downwardly, out of the way during use of the sewing machine for embroidering baseball caps or other three dimensional objects.

DESCRIPTION OF THE PREFERRED EMBODIMENT

Figure 1:
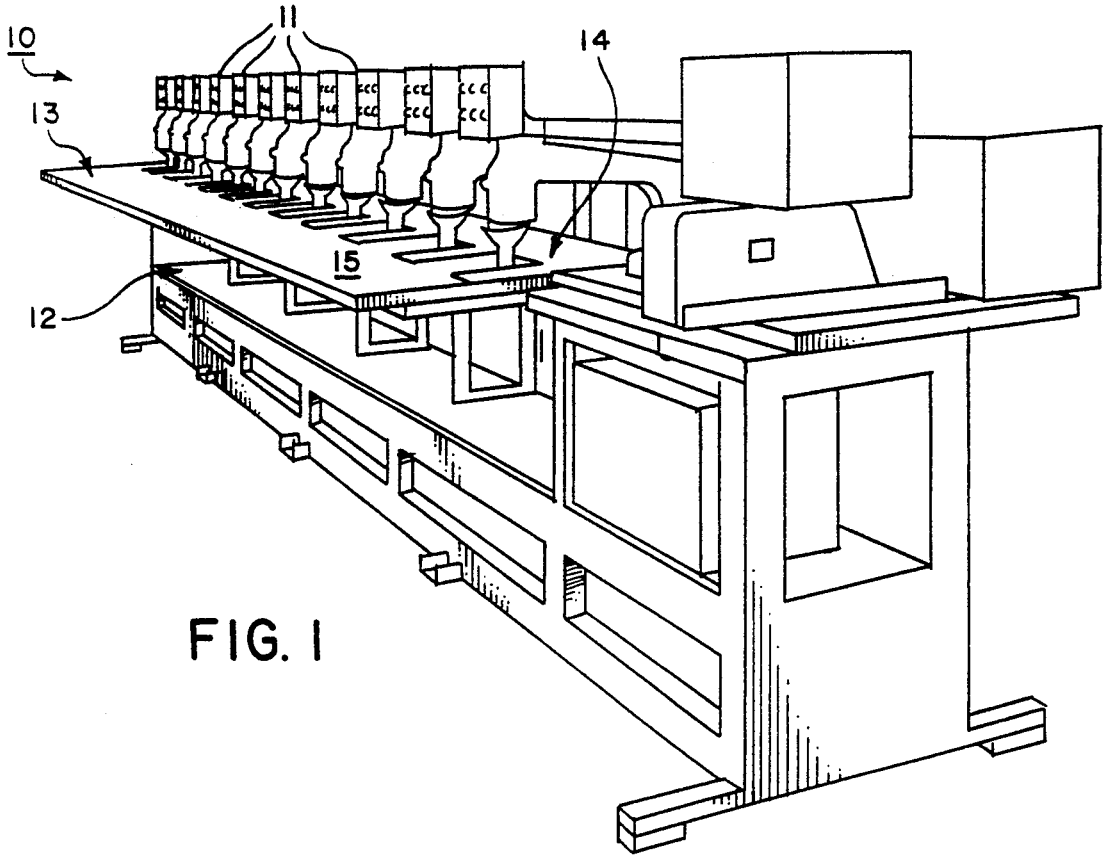
FIG. 1 is a front side perspective view of a conventional multihead sewing machine setup with the movable table section of the present invention in a raised posture.
Figure 2:
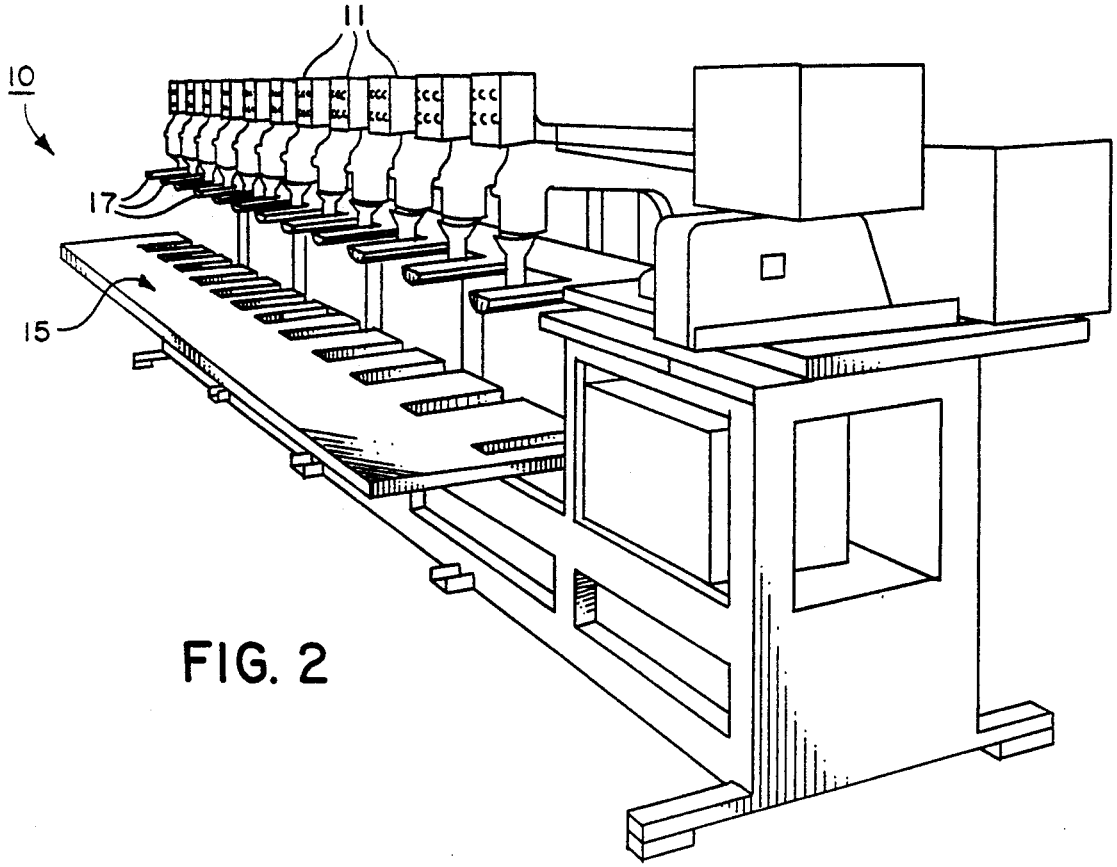
FIG. 2 is the sewing machine setup as shown in FIG. 1 with the table section lowered.
Figure 3:
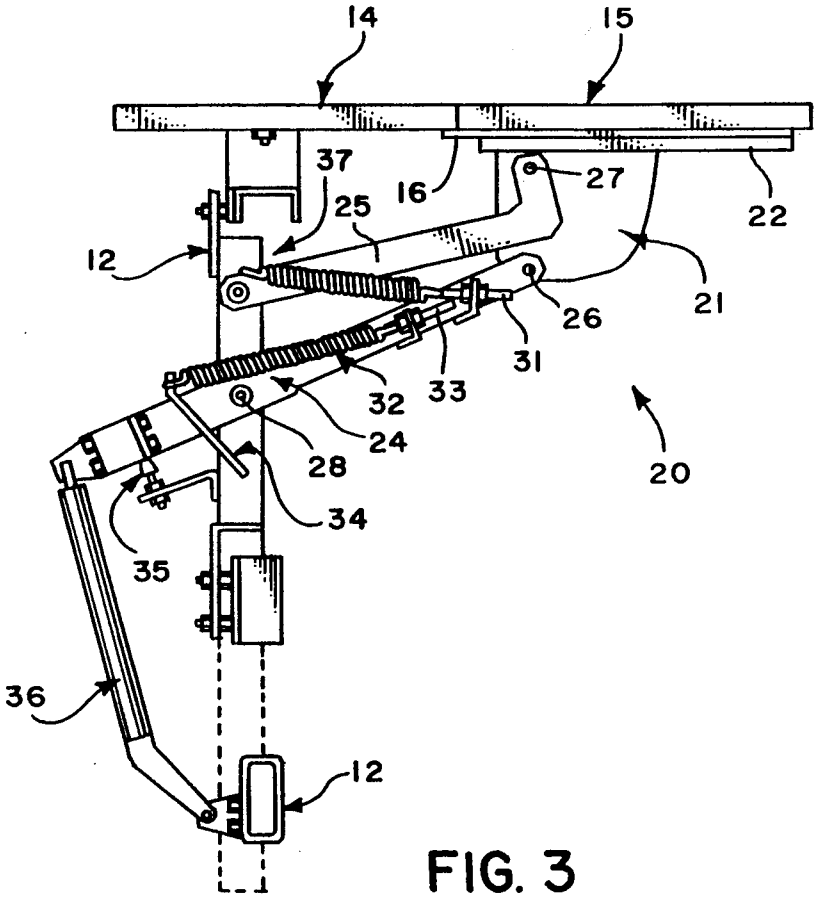
FIG. 3 represents in enlarged fashion the sewing machine mechanism of the present invention in a side elevational view with the table section in a raised position.

The preferred form of the invention is shown in FIGS. 1-5 whereby a sewing machine table having a first, rigid or permanently affixed top section and a second, movable top section are affixed to the table frame. As shown in FIGS. 1 and 2, the movable top table section is changeable from a raised to a lowered position which allows the operator to transform the sewing machine heads from acceptance of conventional flat goods to three dimensional goods such as baseball caps for the purpose of embroidering logos, trademarks or other indicia thereon. The mechanism which allows the movable table top section to so operate is shown in FIG. 3, with the movable top section in a raised position. On a conventional twelve (12) head sewing machine, three (3) such mechanisms are employed. The movable mechanism includes a crank member which is rigidly affixed to the movable table top section and a pair of arms are rotatably affixed to the crank and extend outwardly to the table frame where they are rotatably joined thereto. A pair of resilient coil springs are affixed to the rear of the upper arm and to the lower, linear arm. Both springs (lower and upper) help maintain the movable top section in a raised position whereas the lower spring continues to urge the top section downwardly when the movable top section is in a fully lowered posture (FIG. 5) while the upper spring urges the top section to return upwardly. A means to dampen the upward motion of the pivotal table top section is affixed to the linear arm and includes a hydraulic cylinder which retards the upward motion, thus safety for the operator. A lip is affixed to the movable table top section to insure an even alignment with the permanently affixed first table top section upon raising as the two sections abut.

DETAILED DESCRIPTION OF THE DRAWINGS AND OPERATION OF THE INVENTION

Figure 5:
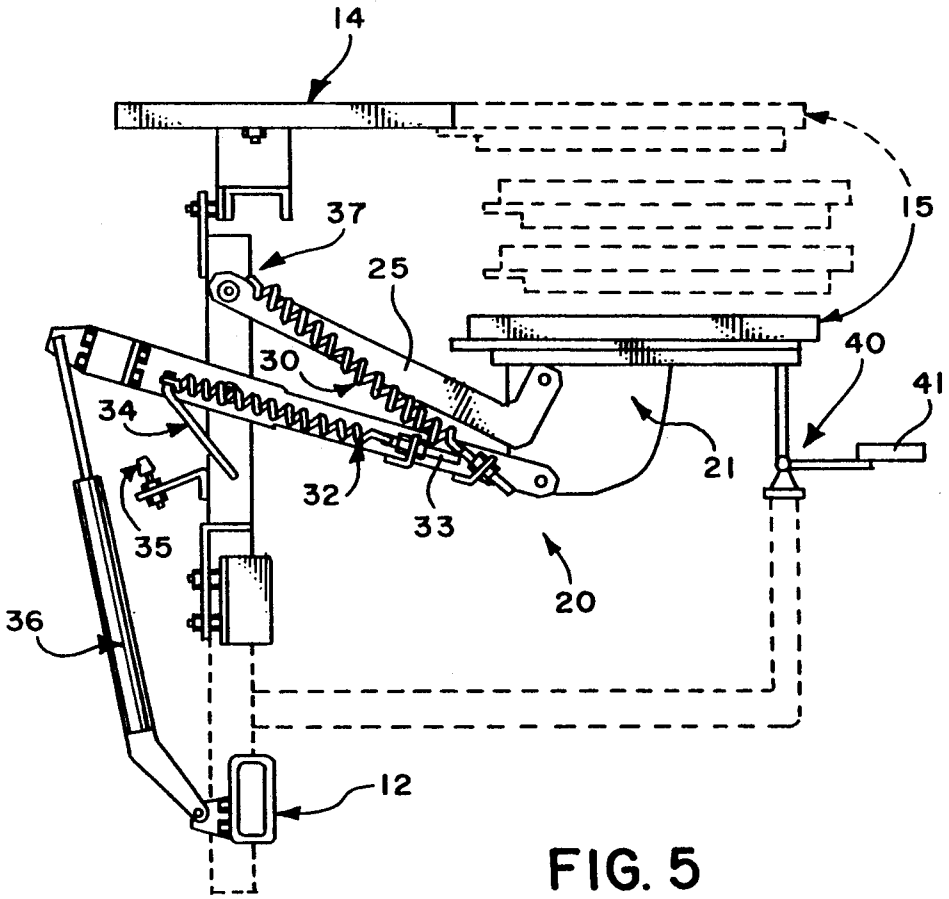
FIG. 5 demonstrates the pivotal mechanism of the invention shown as seen in FIG. 3 with the table section in a fully lowered position.
Figure 4:
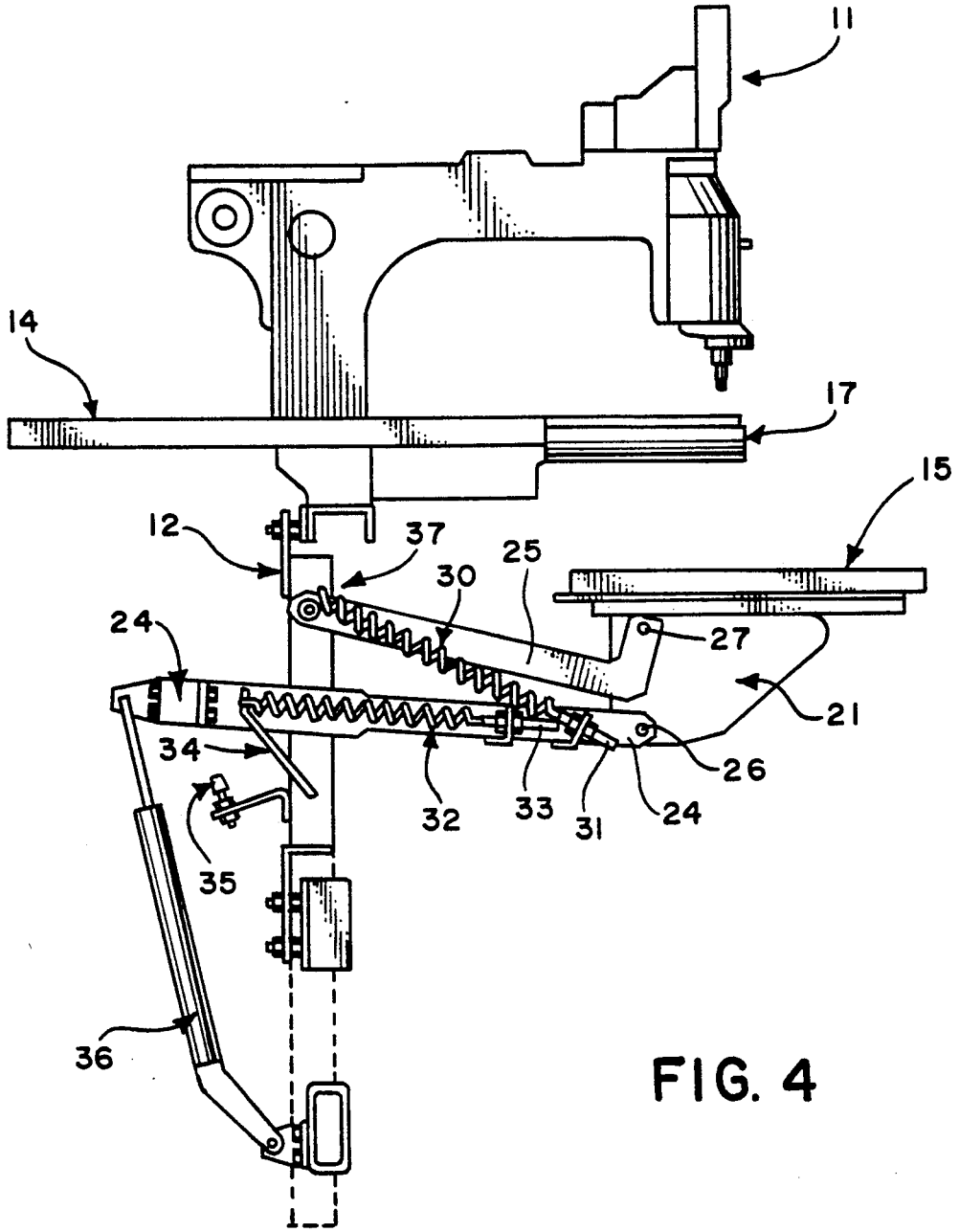
FIG. 4 illustrates the pivotal mechanism of the invention as seen in FIG. 3 with the movable table section in a mid or partial downward position.
Figure 6:
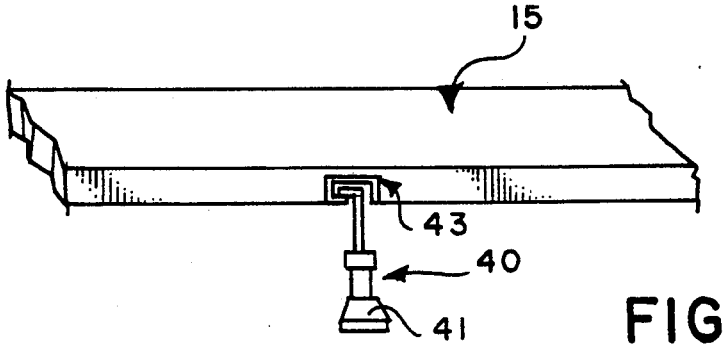
FIG. 6 demonstrates the latch mechanism of the present invention.

For a better understanding of the invention and its operation, turning now to the drawings, sewing machine table 10 is depicted in FIG. 1 having a plurality of twelve sewing machine heads 11 which are affixed to table frame 12. Frame 12 may be made from tubular or channel steel which has been enameled and from other suitable, sturdy materials. Table top 13 which may be of laminated wood or other smooth, planar surface materials having a finished upper surface consists of a first top section 14 which is permanently affixed to table frame 12. First top section 14 may be bolted or like attached to frame 12 and does not move. Second movable top section 15 as seen in FIG. 1 is movably affixed to frame 12 and raised, as shown in FIG. 3, into horizontal alignment with top section 14 whereby flat goods such as shirts or the like can be placed thereon and conveniently stitched by sewing heads 12. As further shown in FIG. 2, second movable top section 15 is lowered, away from sewing machine heads 11. In FIGS. 3 and 5, the fully raised and lowered positions respectively of movable table top section 15 are shown and in FIG. 5, the arcuate path traveled by top section 15 is illustrated in broken lines. An arcuate rotation rather than a straight, vertical lowering of top 15 is accomplished in order to overcome or avoid cylinder arms 17 which are affixed to frame 12 as seen in FIG. 2. Lip member 16 is also shown in FIG. 5 which insures proper alignment with top section 14. In order for top section 15 to lower, a means is provided by mechanism 20 as shown in FIGS. 3, 4 and 5. In FIG. 3, top section 15 is in its raised position in horizontal alignment with top section 14. As further seen therein, top section 15 includes alignment lip member 16 which insures correct horizontal alignment as top section 15 abuts top section 14. Crank member 21 is welded or otherwise rigidly affixed to angle iron support 22 and screws 23 affix angle iron support 22 to top section 15. Linear pivot arm 24 is rotatably attached to crank member 21 through crank arm axle 26 and pivots therearound. L-shaped pivot arm 25 is rotatably joined to crank member 21 through upper crank arm axle 27 as shown in FIG. 3, with axles 26 and 27 in vertical alignment. Likewise, linear pivot arm 24, which is below L-shaped pivot arm 25, is affixed to table frame 12 by lower frame axle 28 whereas L-shaped arm 25 is affixed to frame 12 through upper frame axle 29. Thus, both arms 24 and 25 are affixed to rotate on frame 12 at points in straight vertical alignment.

In FIG. 3, upper coil spring 30 is affixed to the rear of pivot arm 25 at a position slightly above upper frame axle 29. Thus, when table section 15 is in a lowered or downward position as shown in FIG. 5, coil spring 30 is extended and urges table top section 15 upwardly. Threaded adjusting stud 31 comprises a means for tension adjustment of coil spring 30. Likewise, lower coil spring 32 is attached to threaded adjustment stud 33 which comprises a means for tension adjustment of coil spring 32. Coil spring 32 is affixed to frame 12 by bracket 34 which may be welded or otherwise attached to frame 12. Coil spring 32 is shown in an relaxed or contracted posture in FIG. 3 and helps to hold table 15 in its raised position. As shown in FIG. 4, when table section 15 is partially lowered, resilient coil spring 30 is stretched and coil spring 32 is likewise extended or stretched. As seen in FIG. 5, member 35 which likewise is threadably adjustable, acts as a means to stop the rotation of linear arm 24, is affixed to frame 12 and contacts linear pivot arm 24 when table top 15 is in its raised posture as seen in FIG. 3. Hydraulic cylinder 36 which also is conventionally adjustable, provides a means to dampen the upward motion of table section 15 and is likewise joined to frame 12. Spring 30 in FIG. 5 is stretched or extended more so than in FIG. 4, whereas spring 32 is stretched in FIG. 5 but less than in FIG. 4. Accordingly, spring 32 in FIG. 5 urges top section 15 downwardly towards frame 12. Spring 32 thus helps maintain top section 15 in both its upward position (FIG. 3) and in its downward position (FIG. 5) since the pull or force from spring 32 on table top section 15 is upwardly in FIG. 5, due to the slant or bias position of spring 32, as spring 32 is partially below the pivot point (at lower frame axle 28) of arm 24. Spring 30 connection point 37 on arm 25 moves as arm 25 rotates, thus allowing connection point 37 to move downward as arm 25 moves downward.

Latch 40 as seen in FIGS. 4 and 5 includes foot pedal 41 and allows upper end 42 to enter table notch 43 to hold table section 15 in its lowered position. To release top section 15, pedal 41 is depressed whereupon rotation of latch 40 will then allow latch 40 to exit notch 43 permitting top 15 to lift to its raised position as shown in FIG. 5. Table top section 15 as shown herein is moved by manual force, however, electric, pneumatic, hydraulic or other means could also be employed and the illustrations and examples provided herein are for explanatory purposes and are not intended to limit the scope of the appended claims.

I claim:

1. A table comprising: a frame, a first table top section, said first top section rigidly joined to said frame, a second table top section, said second top section movably joined to said frame whereby said second top section is movable from a first position in contiguous horizontal alignment with said first top section to a second lower position vertically spaced from said first top section, means to move said second top section, said moving means comprising a pair of pivot arms, said pivot arms positioned one over the other to provide a top and and a bottom arm, said top and said bottom arms pivotally attached in substantial vertical alignment to said frame, a crank member, said pivot arms rotatable joined to said crank member, said crank member attached to said second top section, a first longitudinal resilient member, said first resilient member having one end attached to said top arm proximate said pivotal attachment and having the other end attached to said bottom arm proximate said crank member, a second longitudinal resilient member, said second resilient member attached at one end to said frame proximate said bottom arm attachment to said frame and at the other end to said bottom arm proximate said first resilient member whereby said second resilient member will alternatively apply upward or downward force to said second top section depending upon the vertical position of said second top section.

2. The table of claim 1 wherein said crank member depends vertically from said second top section.

3. The table of claim 1 and including a means to dampen the upward motion of said second top section, said dampening means joined to one of said pivot arms and to said frame.

4. The table of claim 1 and including means to stop the upward motion of said second top section, said stop means attached to said frame.

5. The table of claim 4 wherein said stop means is threadably adjustable.

6. The table of claim 1 and including means to latch said top section in said second position, said latch means attached to said frame.

7. The table of claim 1 and including means to adjust the tension of said first resilient member, said first tension adjusting means joined to said first resilient member.

8. The table of claim 1 and including means to adjust the tension of said second resilient member, said second tensioning adjusting means joined to said second resilient member.

9. The table of claim 1 and including an alignment lip member, said lip member joined to said second top section for contacting said first top section.

10. A pivotable mechanism for a table top attached to a frame comprising: a crank member, a pair of arms, said arms rotatably joined to said crank member, said crank member affixed to said table top, one of said pair of arms having generally an L-shape, the other of said pair of arms being generally linear, each of said arms pivotally attached to said frame, said linear arm extending from said crank member beyond said attachment on said frame, said L-shaped arm affixed above said linear arm on said crank member, means to dampen the pivotable movement of said table top, said dampening means affixed to said linear arm beyond said frame, a pair of longitudinal resilient members, one end of each of said resilient members joined to said linear arm proximate said crank member, whereby upon pivoting of said table top, said resilient members are elongated.

11. The mechanism of claim 10 and including means to adjust the tension of said resilient member, said ajustment means affixed to said linear arm.

12. The mechanism of claim 10 wherein said arms are affixed in vertical alignment to said crank member.

* * * * *